US005638726A

United States Patent [19]

Pelkonen et al.

[11] Patent Number: 5,638,726

[45] Date of Patent: Jun. 17, 1997

[54] HAND TOOL FOR SCREWING AND UNSCREWING A SCREW MEANS

[76] Inventors: Johan Pelkonen; Pekka Pelkonen, both of Violvägen 15, S-340 14 Lagan, Sweden

[21] Appl. No.: 448,602

[22] PCT Filed: Dec. 7, 1993

[86] PCT No.: PCT/SE93/01056

§ 371 Date: Jun. 7, 1995

§ 102(e) Date: Jun. 7, 1995

[87] PCT Pub. No.: WO94/13436

PCT Pub. Date: Jun. 23, 1994

[30] Foreign Application Priority Data

Dec. 7, 1992 [SE] Sweden ..... 9203678

[51] Int. Cl.[6] ..... B25B 13/00; B25G 1/02

[52] U.S. Cl. ..... 81/57.43; 81/177.6; 81/177.2

[58] Field of Search ..... 81/57.43, 177.6, 81/177.2

[56] References Cited

U.S. PATENT DOCUMENTS 2,704,005 3/1955 Clayson .

2,892,477 6/1959 Holt .

FOREIGN PATENT DOCUMENTS 109337 12/1943 Sweden .

467532 5/1991 Sweden .

*Primary Examiner*—D. S. Meislin

*Attorney, Agent, or Firm*—Young & Thompson

[57] ABSTRACT

A hand tool for tightening or loosening screw elements such as bolts consists of an elbow pipe (24) in which a displaceable and rotatable flexible shaft (26) is mounted. A handle (30) is attached to the rear end of the shaft in order to rotate and displace the shaft inside the elbow pipe (24). A holder (40) with a hexagonal socket for receiving bits is arranged at the front end of the shaft. When the handle is moved to its rearmost position, locking elements cooperate to prevent the holder from rotating in relation to the pipe. When the handle is moved to its forward position these locking elements are disengaged so that the holder and gripping elements can be rotated with the handle.

9 Claims, 3 Drawing Sheets

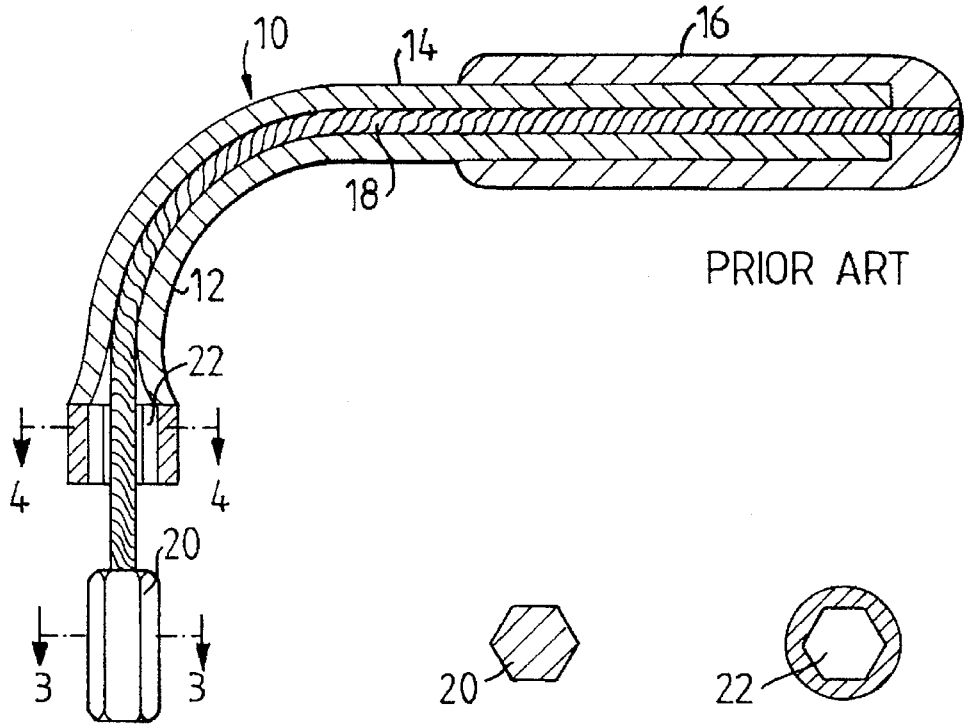
PRIOR ART
FIG. 1
FIG. 3
FIG. 4
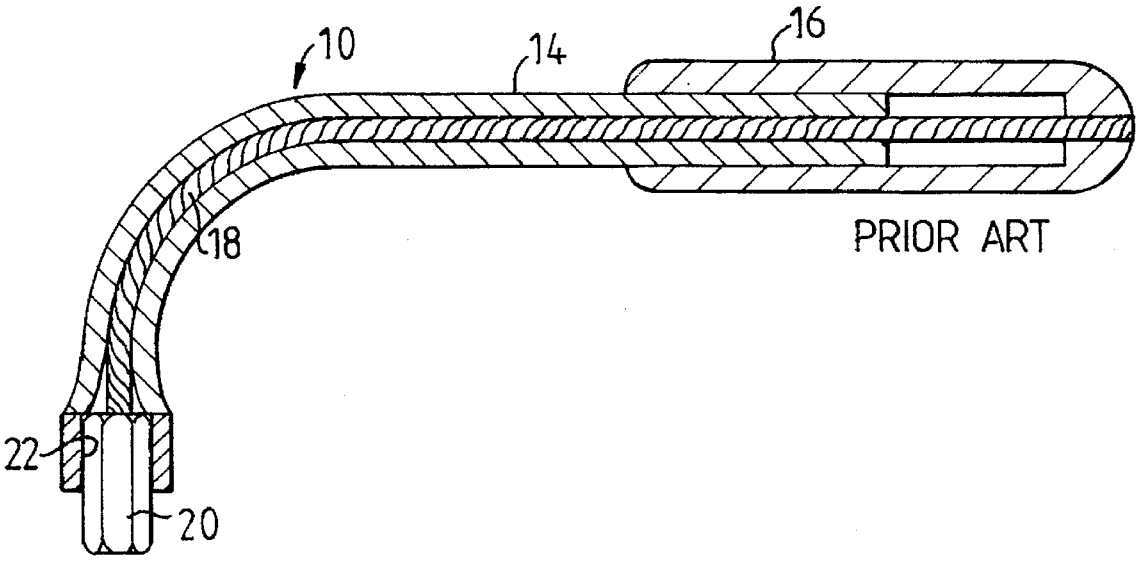
PRIOR ART
FIG. 2

HAND TOOL FOR SCREWING AND UNSCREWING A SCREW MEANS

The present invention relates to a hand tool for screwing and unscrewing a screw means. Such a tool is known by SE 467 532 and is shown in the attached FIGS. 1–4.

In this known tool, a flexible shaft is rotatable and displaceable in an angled tube. A handle is fixed to the rear end of the shaft to operate the same. To the front end of the shaft, there is fixed an engaging means with a hexagonal cross section. To the front end of the tube, there is fixed a holder with a hexagonal socket for receiving the engaging means in non-rotational relation. When the engaging means is to be rotated with the aid of the handle, the engaging means is pressed out to a free position outside the holder and at the same time a portion of the shaft will be exposed outside the holder. If the engaging means is subjected to lateral forces, these will be taken up at the fixing point between the shaft end and the engaging means with the risk of fracture at the point of attachment. If the engaging means is also extended with another engaging means, the lateral forces will have a longer lever which will increase the risk of fracture at the point of attachment. The purpose of the invention is to eliminate this disadvantage and make possible detachable mounting of various types of engaging means without the risk of fracture at any point of attachment.

This is achieved by a hand tool in which, as an engaging means, there is used an interchangeable tip or bit, the front portion of which is a regular screwdriver tip, a cross-head screwdriver tip, a hexagonal pin, a hexagon nut socket or other tool, the rear portion of which is hexagonal in cross-section and is removably insertable into a holder to a non-rotatable position therein. The invention is characterized in that the holder has a socket portion which in all positions is guided relative to a corresponding portion of the front end portion of the tube. The engaging means can be held in the holder by a magnet, with a snap coupling or by other known means. The holder has a cylindrical bearing surface which cooperates with a corresponding bearing surface on the front end of the tube and which has such a length that the lateral forces can be absorbed without any risk of fracture at any point of attachment.

In the accompanying drawings, the known tool is shown in FIGS. 1–4. FIGS. 5–10 show different embodiments of a tool with a holder according to the invention for interchangeable holding of an engaging means.

FIG. 1 is a longitudinal section through the known tool with the handle in its forward end position and the engaging means in its advanced end position free of the end of the tube.

FIG. 2 is the same longitudinal section as in FIG. 1, but with the handle in its rear end position and the engaging means in its retractire position in the holder fixed to the end of the tube.

FIG. 3 is a cross section along the line 3—3 in FIG. 1 through the engaging means in the form of a hex-head pin.

FIG. 4 is a cross section along the line 4—4 in FIG. 1 through the hexagonal socket for receiving the hex-head pin.

Figure 5:
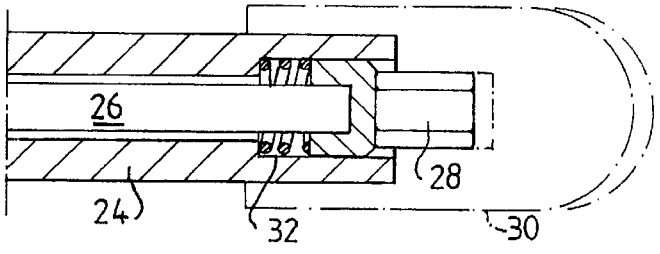
Figure 5:
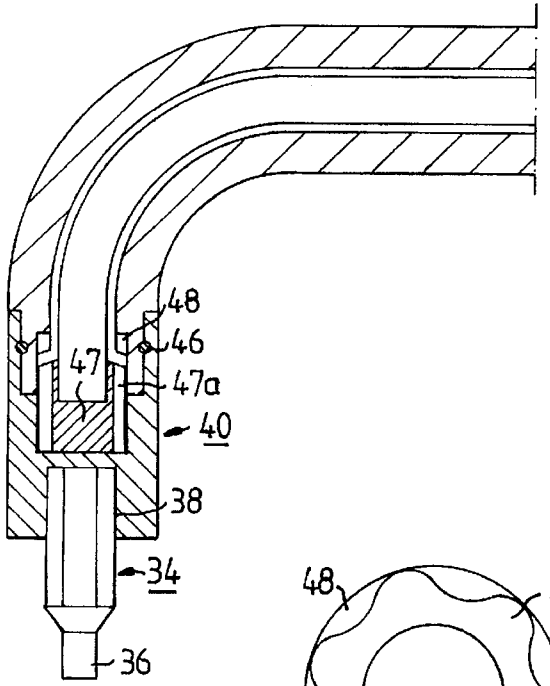

FIGS. 5–10 show different variants of a holder according to the invention for interchangeable engaging means with the end in the form of a screwdriver, a cross-head screwdriver or other tips, which are available on the market in sets of tips. The holder, in its various embodiments in FIGS. 5–8, is locked against rotation relative to the tool by means of cooperating cogs or teeth when the rotating shaft is in its retractire position, and is released for rotation relative to the tube when the rotational shaft is in its extended position in the tube, where the cooperating cogs or teeth are out of engagement.

The numeral 10 designates an angle tube with two main components 12 and 14, which form approximately a right angle with each other.

The longer straight tube portion 14 has mounted thereon a rotatable and longitudinal displaceable handle 16, which, in its forward end position according to FIG. 1 is in contact with the end of the tube 14.

To the handle 16 there is fixed a flexible rotational shaft 18, such as a cable of known design. The shaft extends rotatably through the tube 10 and out from the end of the tube portion 12 to the position shown in FIG. 1. To this end of the shaft, there is fixed a hexagonal pin 20 which is intended to fit into a corresponding hex-head socket in a bolt head or the like (not shown).

The end of the tube portion 12 is extended with a nut socket welded thereto, forming a hexagonal socket 22 for receiving the hexagonal pin 20 in the manner shown in FIG. 2.

In the position shown in FIG. 1, the pin 20 can be easily rotated by rotating the handle 16. This is particularly advantageous in confined spaces. After the bolt has been screwed to the bottom and is to be tightened, this can be done quite simply. The handle 16 is pulled back to its rear end position shown in FIG. 2, and the shaft follows it and pulls in the pin 20 into a non-rotating position in the socket 22. The tool will now function as a fixed wrench with a handle which provides a relatively long lever to produce high torque for the final tightening of the bolt or the like, or for initial unscrewing of the bolt.

Figure 7:
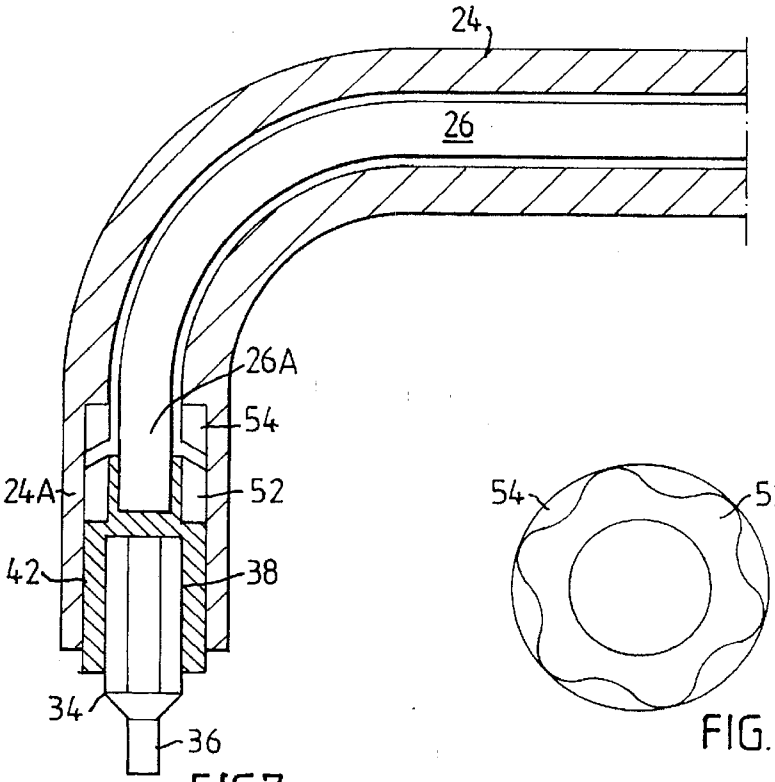
Figures 9, 10:
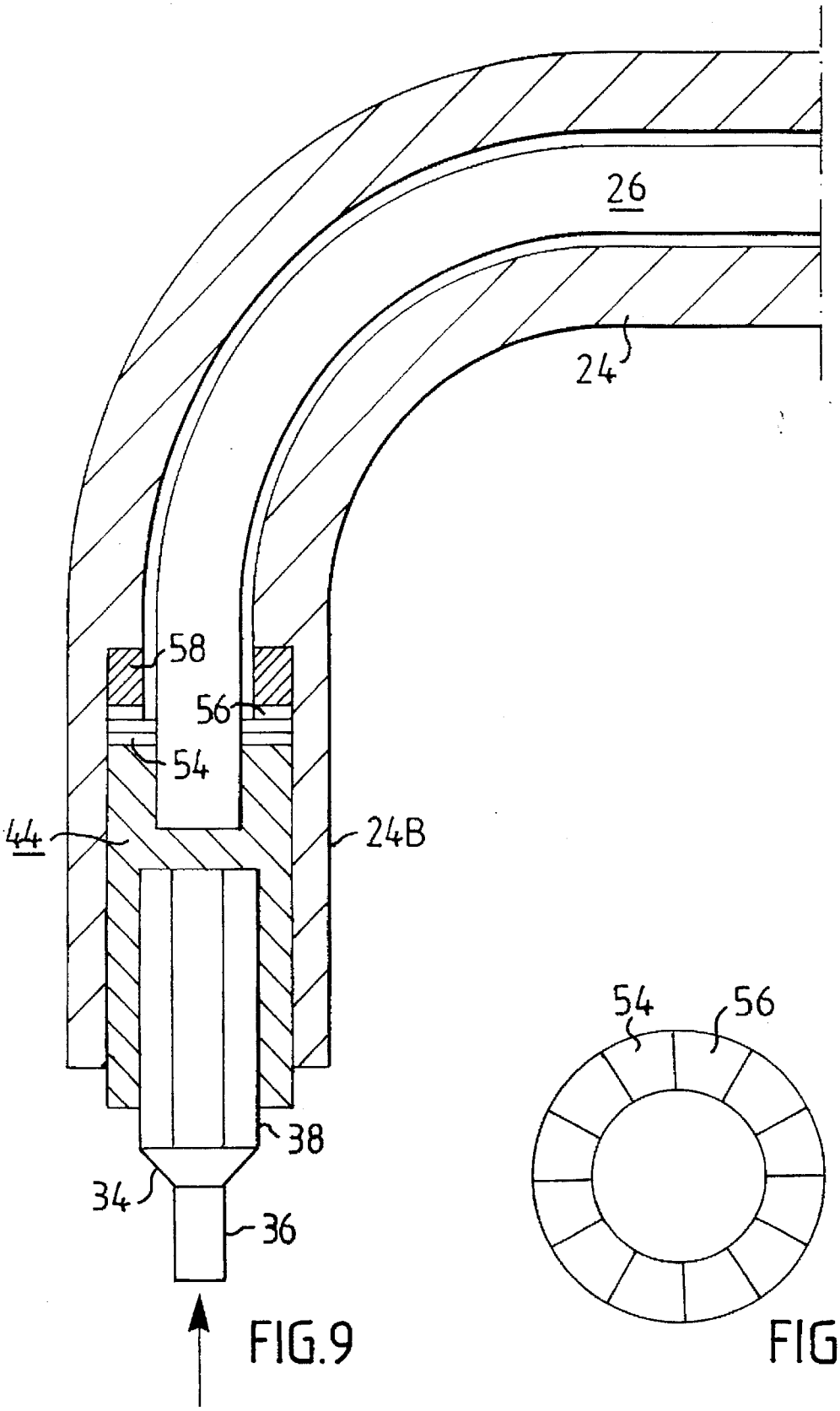

In FIGS. 5, 7 and 9, the numeral 24 designates the angle tube, in which the flexible shaft 26 is rotatable and longitudinally displaceable. At the rear end of the shaft, there is fixed an end piece with a hexagonal pin 28 for receiving a handle 30. The rear end of the shaft is biased by a compression spring 32, which pushes the shaft towards its rear end position, where the shaft is locked against rotation relative to the tube by one of the methods described below. Pressing the handle 30 against the force of the spring 32 will displace the shaft 26 to its forward position for free rotation of the shaft 26.

FIGS. 5, 7 and 9 show an engaging means, in this case in the form of a screwdriver tip or bit 34, the end of which can be a regular screwdriver, a cross-head screwdriver or other rotating means. The rear portion 38 has a known hexagon section and is non-rotatably inserted in a hexagon socket in a holder, generally designated 40 in FIG. 5, 42 in FIG. 7, and 44 in FIG. 9.

Figure 6:
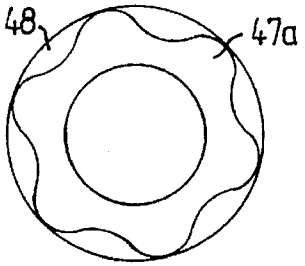

In FIGS. 5 and 6, the rear end of the holder 40 is socket-shaped and is rotatably mounted on the forward end of the tube 24, held securely thereon axially with an annular locking means 46.

A disc 47 is fixed to the front end of the shaft 26. The disc has axial cogs or teeth **47*a* and is axially displaceable in a cavity in the holder. The axial cogs or teeth 48** on the walls of the cavity are engaged, by displacement of the disc, with the teeth of the disc to prevent rotation of the disc relative to the holder. Displacement of the disc in the opposite direction releases the teeth from each other.

FIG. 6 shows the teeth **47*a* and 48 in an end view. In the position shown in FIG. 5, the tube 24 can be held stationary, and the holder 42 with the engaging means 34 in place in the screw, can be rotated by means of the handle 30. When the handle is released, the spring 32 forces the shaft 26 back to its retracted position and the teeth 47*a*,48 will engage with each other, thus locking the holder 40 to the tube 24. The long portion of the tube can then be used as a lever for turning the holder 40 with the engaging means. A particular advantage of this device is that the holder 40 has a constant axial position in the tube 24 and is in contact with its end against an abutment on the outside of the tube, which means that if one applies pressure to the tube 24 to produce a better engagement between the engaging means and the screw, this can be easily done by applying pressure to the tool and rotating the long section at the same time. As can be seen in FIG. 5, the holder is always mounted in place and absorbs any lateral forces on the engaging means, so that they are not transferred to the point of attachment between the disc 47 and the end of the shaft 26**.

Figure 8:
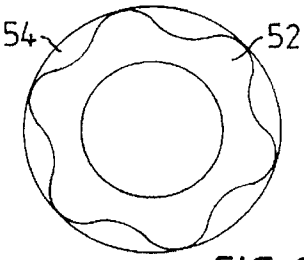

FIGS. 7 and 8 show an alternative where the holder 42 is displaceable and rotatable within the end portion 24A of the tube. The holder is securely joined to the end 26A of the shaft. The holder is shown in FIG. 7 in its advanced and rotatable end position. At the rear end portion of the holder there are a number of axial teeth 52 lying axially free from corresponding axial teeth 54 on the inside of the tube end, in the position shown in FIG. 7 for rotating the holder. When the pressure on the handle is released, the spring 32 (FIG. 5) will push the shaft 26 back so that the teeth 52,54 will engage with each other and lock the holder to the tube.

The holder is in this case as well securely mounted and can absorb lateral forces without they being transferred to the point of attachment between the holder and the end of the shaft.

In FIGS. 9 and 10, the holder 44 is rotatable and is displaceable within the tube end 24B. The holder is solidly joined to the shaft 26. The rear end of the holder is provided with radial teeth 54, and corresponding radial teeth 56 are on a washer 58 fixed inside the tube end. When the shaft 26 and the holder are retracted by the spring 32, the teeth 54,56 engage and lock the holder against rotation relative to the tube. When the shaft is advanced, the engagement is broken between the teeth 54,56, and the holder with the engaging means can be rotated relative to the tube. An advantage of this locking device is that the displacement movement between the advanced and retracted end positions can be kept relatively small in relation to the other embodiments described above. In this case as well, the holder is held securely to absorb lateral forces to prevent fracture between the end of the shaft 26 and the holder.

An additional advantage of the holder shown in FIGS. 5, 7 and 9, is that the interacting teeth of the holder and the tube are protected within the tube and are prevented from becoming soiled, which could impair engagement of the teeth.

We claim:

1. In a hand tool for screwing and unscrewing a screw means that has a screw head, said tool having means for non-rotatably engaging a said screw head, said tool comprising a handle comprising an angled tube, a flexible shaft extending within said angled tube, means at one end of said tube for moving said shaft lengthwise of said tube between an extended position and a retracted position, said engaging means being interconnected with the other end of said flexible shaft such that in said extended position of said flexible shaft said engaging means and said flexible shaft are rotatable relative to said angled tube and in said retracted position of said flexible shaft said flexible shaft and said engaging means are fixed against rotation relative to said angled tube; the improvement wherein said engaging means is supported on and by an end of said angled tube both in said retracted position of said flexible shaft and in said extended position of said flexible shaft.

2. A tool as claimed in claim 1, wherein said engaging means has a polygonal socket for releasably retaining a tool engageable with a said screw head.

3. A tool as claimed in claim 2, wherein said polygonal socket is hexagonal.

4. A tool as claimed in claim 1, wherein said engaging means is rotatably mounted with an inner cylindrical bearing surface on a corresponding external cylindrical bearing surface on said end of the angled tube.

5. A tool as claimed in claim 1, wherein said other end of said flexible shaft and said end of said hollow tube have noncircular portions thereon that are out of engagement with each other in said extended position of said flexible shaft and are in mating engagement with each other in said retracted position of said flexible shaft to prevent rotation of said flexible shaft relative to said tube.

6. A tool as claimed in claim 1, and means preventing rotation of said flexible shaft relative to said engaging means but permitting lengthwise movement of said flexible shaft between said extended and retracted positions relative to said engaging means.

7. A tool as claimed in claim 6, and means preventing movement of said engaging means lengthwise of and relative to said tube but permitting rotation of said engaging means relative to said tube.

8. A tool as claimed in claim 1, and spring means continuously urging said flexible shaft toward said retracted position.

9. A tool as claimed in claim 1, said engaging means extending within said end of said angled tube both in said retracted and in said extended position of said flexible shaft.

* * * * *